US010353306B2

(12) United States Patent
Watanabe

(10) Patent No.: US 10,353,306 B2
(45) Date of Patent: Jul. 16, 2019

(54) METHOD FOR PRODUCING NEGATIVELY CHARGEABLE TONER, AND NEGATIVELY CHARGEABLE TONER

(71) Applicant: ZEON CORPORATION, Tokyo (JP)

(72) Inventor: Masashi Watanabe, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 15/561,722

(22) PCT Filed: Mar. 10, 2016

(86) PCT No.: PCT/JP2016/057557

§ 371 (c)(1),
(2) Date: Sep. 26, 2017

(87) PCT Pub. No.: WO2016/158288

PCT Pub. Date: Oct. 6, 2016

(65) Prior Publication Data

US 2018/0107127 A1 Apr. 19, 2018

(30) Foreign Application Priority Data

Mar. 31, 2015 (JP) ..... 2015-073274

(51) Int. Cl.

| | |
|---|---|
| ***G03G 9/087*** | (2006.01) |
| ***G03G 9/08*** | (2006.01) |
| ***G03G 9/09*** | (2006.01) |
| ***G03G 9/097*** | (2006.01) |

(52) U.S. Cl.

CPC ..... *G03G 9/08* (2013.01); *G03G 9/087* (2013.01); *G03G 9/08706* (2013.01); *G03G 9/09* (2013.01); *G03G 9/097* (2013.01)

(58) Field of Classification Search

CPC .. G03G 9/0802; G03G 9/0804; G03G 9/0806; G03G 9/09733; G03G 9/09775

See application file for complete search history.

(56) References Cited

U.S. PATENT DOCUMENTS

| | | | | |
|---|---|---|---|---|
| 2005/0165139 | A1* | 7/2005 | Kawakami | C08J 3/16 524/17 |
| 2011/0159425 | A1* | 6/2011 | Itabashi | G03G 9/08706 430/108.2 |
| 2013/0171552 | A1* | 7/2013 | Yoshizaki | G03G 9/0825 430/108.4 |

FOREIGN PATENT DOCUMENTS

| | | | |
|---|---|---|---|
| JP | 63-210852 | A | 9/1988 |
| JP | S64-61762 | A | 3/1989 |
| JP | H03-15858 | A | 1/1991 |
| JP | H11-184165 | A | 7/1999 |
| JP | 2005-165155 | A | 6/2005 |

OTHER PUBLICATIONS

Notification of Transmittal of Translation of the International Preliminary Report on Patentability (Cahper I) (PCT/IB/338) dated Oct. 12, 2017, issued in PCT/JP2016/057557.

* cited by examiner

*Primary Examiner* — Peter L Vajda
(74) *Attorney, Agent, or Firm* — Westerman, Hattori, Daniels & Adrian, LLP

(57) ABSTRACT

To provide an efficient method for producing a negatively chargeable toner in which a carbon black (as a colorant) is well dispersed and which has high chargeability, has excellent transfer efficiency, prevent a white spot and provides an image with sufficient image density. Disclosed is a method for producing a negatively chargeable toner, the method including: a suspension step of obtaining a suspension in which droplets of a polymerizable monomer composition containing at least a polymerizable monomer, a carbon black, a softening agent and a charge control agent, which is a specific, sulfonic acid group-containing copolymer, are dispersed, by suspending the polymerizable monomer composition in an aqueous dispersion medium containing a dispersion stabilizer, and a step of obtaining colored resin particles by suspension polymerization using the suspension in the presence of a polymerization initiator.

8 Claims, No Drawings

METHOD FOR PRODUCING NEGATIVELY CHARGEABLE TONER, AND NEGATIVELY CHARGEABLE TONER

TECHNICAL FIELD

The present invention relates to a method for producing a negatively chargeable toner that can be used for development in image forming devices using electrophotography, such as a copy machine, a facsimile machine and a printer. The present invention also relates to a negatively chargeable toner obtained by the production method.

BACKGROUND ART

In recent years, there is an increasing need for electrophotographic color image forming devices such as a multifunctional printer, a facsimile machine and a printer. Color printing is required to reproduce color tones that are as high-resolution and sharp as photographs. Accordingly, there is a demand for color toners that can meet the request. Such toners are required to have various kinds of printing properties such as environmental stability (from the viewpoint of preventing a deterioration in image quality due to an environmental change in temperature, humidity, etc.), printing durability (from the viewpoint of reducing printing costs), and low-temperature fixability (from the viewpoint of reducing power consumption).

To meet the request, a spherical toner with a small particle diameter is suitable, which can achieve both excellent transferability and dot reproducibility. As the method for producing the toner, a polymerization method (a wet granulation method) has been proposed. In the case of a conventional pulverization method, especially in the case of producing a toner with a small particle diameter by the method, a low yield is obtained, and a lot of energy is consumed by pulverization. Meanwhile, in the case of the polymerization method, a high yield is obtained; energy consumption is low since a pulverization process is not necessary; and a spherical toner can be easily produced.

In the case of obtaining colored resin particles by the polymerization method, it is advantageous in that at the step of forming particles (the step of forming and polymerizing droplets in the case of the polymerization method, and the step of pulverization in the case of the pulverization method), spherical colored resin particles with a smaller particle diameter and a narrower particle size distribution than those produced by the conventional pulverization method, can be famed.

However, along with a further increase in the level of demand for high resolution and high quality, it has been pointed out that the polymerization toner has problems that must be solved.

In the case of producing a toner by the above-described polymerization method, there is a problem in that it is difficult to uniformly disperse a pigment (colorant) in the toner, and the image density of an image thus famed decreases. As a means to solve the problem, if the amount of the pigment added to the toner is increased so as to obtain sufficient image density, aggregation of the pigment occurs in the toner and causes the charge performance of the toner to be unstable, resulting in problems such as a void and toner scattering.

As a method to solve the problem, in Patent Document 1, it is disclosed that in the case of producing a toner by a wet granulation method, if a pigment subjected to a coupling treatment with a coupling agent is used, the dispersibility of the colorant is increased; the chargeability of the toner is stabilized; and an image with sufficient image density is obtained, preventing a void toner scattering.

CITATION LIST

Patent Document 1: Japanese Patent Application Laid-Open (JP-A) No. 2005-165155

SUMMARY OF INVENTION

Technical Problem

However, as a result of studying Patent Document 1, the inventors of the present invention found that while a suspension polymerization method, an emulsion dispersion method, an emulsion polymerization aggregation method and so on are described in paragraph [0006] as wet granulation method examples, toner production was carried out only by the emulsion polymerization aggregation method under "Examples". When the method described in Patent Document 1 is carried out by a suspension polymerization method in which a carbon black (CB) is used as a colorant, the dispersibility of the carbon black in the toner is insufficient and causes a void, etc.

In the suspension polymerization method, first, a polymerizable monomer, a colorant and, as needed, other additives are mixed to prepare a polymerizable monomer composition, and the composition is dispersed in an aqueous dispersion medium comprising a dispersion stabilizer. Next, using a high-speed agitator or the like, the aqueous dispersion medium in which the polymerizable monomer composition is dispersed, is subjected to high shear, thereby forming the polymerizable monomer composition into droplets. Then, the aqueous dispersion medium in which the thus-formed droplets of the polymerizable monomer composition are dispersed, is polymerized in the presence of a polymerization initiator, followed by filtration using a filtering material, washing and drying, thereby obtaining colored resin particles.

While the dispersion system of the colorant is an oil phase in the suspension polymerization method, it is an aqueous phase in the emulsion polymerization aggregation method described under "Examples" in Patent Literature 1. That the difference has a large influence on the dispersibility of the carbon black, is thought to contribute to the problem.

In general, in the case of using a carbon black as a colorant, the electrical resistance of a toner decreases, and it is needed to use a highly chargeable charge control agent, therefore. However, in the case of obtaining a negatively chargeable toner using the highly chargeable charge control agent, the carbon black is likely to aggregate. This is also thought to contribute to the problem.

An object of the present invention is to solve the problem and provide an efficient method for producing a negatively chargeable toner in which a carbon black (as a colorant) is well dispersed and which has high chargeability, has excellent transfer efficiency, prevents a white spot and provides an image with sufficient image density.

Solution to Problem

As a result of diligent research made to achieve the above object, the inventors of the present invention found that the object can be achieved by preparing a polymerizable monomer composition by mixing a polymerizable monomer, a carbon black, a softening agent, an aluminum coupling agent, and a charge control agent that is a copolymer in which the copolymerization ratio of the sulfonic acid group-containing (meth)acrylamide monomer unit is within the specific range.

According to the present invention, a method for producing a negatively chargeable toner is provided, the method comprising: a suspension step of obtaining a suspension in which droplets of a polymerizable monomer composition comprising at least a polymerizable monomer, a carbon black, a softening agent and a charge control agent are dispersed, by suspending the polymerizable monomer composition in an aqueous dispersion medium comprising a dispersion stabilizer, and a step of obtaining colored resin particles by suspension polymerization using the suspension in the presence of a polymerization initiator, wherein the polymerizable monomer composition is prepared by mixing the polymerizable monomer, the carbon black, the softening agent, an aluminum coupling agent, and the charge control agent that is a sulfonic acid group-containing copolymer which is obtained by copolymerizing a vinyl aromatic hydrocarbon, a (meth)acrylate and a sulfonic acid group-containing (meth)acrylamide and in which a copolymerization ratio of a sulfonic acid group-containing (meth)acrylamide monomer unit in the copolymer is from 0.8 to 4.0% by mass.

In the method for producing the negatively chargeable toner according to the present invention, a content of the softening agent in the polymerizable composition is preferably from 1 to 25 parts by mass with respect to 100 parts by mass of the polymerizable monomer.

In the method for producing the negatively chargeable toner according to the present invention, a weight average molecular weight of the charge control agent is preferably from 5,000 to 30,000.

In the method for producing the negatively chargeable toner according to the present invention, a content of the charge control agent in the polymerizable composition is preferably from 0.1 to 8.0 parts by mass with respect to 100 parts by mass of the polymerizable monomer.

Also according to the present invention, a negatively chargeable toner obtained by the method for producing the negatively chargeable toner according to the present invention, is provided.

Advantageous Effects of Invention

According to the present invention, an efficient method for producing a negatively chargeable toner, which is a toner in which a carbon black (as a colorant) is well dispersed and which has high chargeability, has excellent transfer efficiency, prevents a white spot and provides an image with sufficient image density, is provided by preparing a polymerizable monomer composition by mixing a polymerizable monomer, a carbon black, a softening agent, an aluminum coupling agent, and a copolymer in which the copolymerization ratio of the sulfonic acid group-containing (meth) acrylamide monomer unit is within the specific range.

According to the production method of the present invention, a negatively chargeable toner is provided, which is a toner in which a carbon black (as a colorant) is well dispersed and which has high chargeability, has excellent transfer efficiency, prevents a white spot and provides an image with sufficient image density.

DESCRIPTION OF EMBODIMENTS

The method for producing a negatively chargeable toner according to the present invention is a method comprising: a suspension step of obtaining a suspension in which droplets of a polymerizable monomer composition comprising at least a polymerizable monomer, a carbon black, a softening agent and a charge control agent are dispersed, by suspending the polymerizable monomer composition in an aqueous dispersion medium comprising a dispersion stabilizer, and a step of obtaining colored resin particles by suspension polymerization using the suspension in the presence of a polymerization initiator, wherein the polymerizable monomer composition is prepared by mixing the polymerizable monomer, the carbon black, the softening agent, an aluminum coupling agent, and the charge control agent that is a sulfonic acid group-containing copolymer which is obtained by copolymerizing a vinyl aromatic hydrocarbon, a (meth) acrylate and a sulfonic acid group-containing (meth)acrylamide and in which a copolymerization ratio of a sulfonic acid group-containing (meth)acrylamide monomer unit in the copolymer is from 0.8 to 4.0% by mass.

The negatively chargeable toner of the present invention is a negatively chargeable toner obtained by the production method of the present invention.

In the present invention, the term "(meth)acrylate" includes both acrylate and methacrylate. Also in the present invention, the team "(meth)acrylamide" includes both acrylamide and methacrylamide.

Hereinafter, the method for producing a negatively chargeable toner (hereinafter it may be simply referred to as "toner") according to the present invention will be described.

The toner production method of the present invention comprises a suspension step of obtaining a suspension in which droplets of a polymerizable monomer composition comprising at least a polymerizable monomer, a carbon black, a softening agent and a charge control agent are dispersed, by suspending the polymerizable monomer composition in an aqueous dispersion medium comprising a dispersion stabilizer, and a step of obtaining colored resin particles by suspension polymerization using the suspension in the presence of a polymerization initiator.

Hereinafter, the suspension step of obtaining a suspension in which droplets of a polymerizable monomer composition are dispersed, which is a step included in the production method of the present invention, the step of obtaining colored resin particles by suspension polymerization using the suspension in the presence of a polymerization initiator, which is a step included in the production method of the present invention, a step of producing a toner using the colored resin particles, and the toner obtained by the production method of the present invention, will be described in order.

1. Suspension Step

The Suspension used in the production method of the present invention is produced by the following processes.

(1) Preparation of Polymerizable Monomer Composition

A polymerizable monomer composition is prepared by mixing a polymerizable monomer, a carbon black, a softening agent, an aluminum coupling agent and a charge control agent, and other additives added as needed, such as a molecular weight modifier. In the preparation of the polymerizable monomer composition, the mixing is carried out by means of a media-type dispersing machine, for example.

In the present invention, the polymerizable monomer means a monomer having a polymerizable functional group, and the polymerizable monomer is polymerized to be a binder resin. As a main component of the polymerizable monomer, a monovinyl monomer is preferably used. As the monovinyl monomer, examples include, but are not limited to, styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Of them, styrene, styrene derivatives, and acrylic acid esters or methacrylic acid esters are suitably used for the monovinyl monomer.

In order to improve hot offset and heat-resistant storage stability, it is preferable to use a crosslinkable polymerizable monomer together with the monovinyl monomer. The crosslinkable polymerizable monomer means a monomer having two or more polymerizable functional groups. As the crosslinkable polymerizable monomer, examples include, but are not limited to, aromatic divinyl compounds such as divinyl benzene, divinyl naphthalene and derivatives thereof; ester compounds such as ethylene glycol dimethacrylate and diethylene glycol dimethacrylate, in which two or more carboxylic acids having a carbon-carbon double bond are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the production method of the present invention, it is desirable that the amount of the crosslinkable polymerizable monomer is generally from 0.1 to 5 parts by mass, and preferably from 0.3 to 2 parts by mass, with respect to 100 parts by mass of the monovinyl monomer.

Also, it is preferable to use a macromonomer as a part of the polymerizable monomer, since the balance between the storage stability and low-temperature fixability of the toner thus obtained can be improved. The macromonomer is a reactive oligomer or polymer having a polymerizable carbon-carbon unsaturated double bond at the end of a polymer chain and generally having a number average molecular weight of from 1,000 to 30,000. The macromonomer is preferably one that can provide a polymer having a higher glass transition temperature (hereinafter may be referred to as "Tg") than a polymer obtained by polymerizing the monovinyl monomer.

The amount of the macromonomer is preferably from 0.03 to 5 parts by mass, and more preferably from 0.05 to 1 part by mass, with respect to 100 parts by mass of the monovinyl monomer.

In the production method of the present invention, a carbon black is used as a colorant.

As described above, in the case of using a carbon black as a colorant, the electrical resistance of a toner decreases, resulting in a decrease in image density. To increase image density, it is possible to increase the amount of the carbon black added. However, it has a problem in that as the added amount increases, the charge amount of the thus-obtained toner decreases. To increase the charge amount, it is possible to use a highly chargeable charge control agent. However, in the case of obtaining a negatively chargeable toner using the highly chargeable charge control agent, it has a problem of aggregation of the carbon black. Due to such problems, production methods of prior art have difficulty in producing a toner that can satisfy many demands with balance and at a high level.

In the present invention, the content of the carbon black in the polymerizable monomer composition is preferably from 1 to 10 parts by mass with respect to 100 parts by mass of the polymerizable monomer. When the content of the carbon black is less than 1 part by mass with respect to 100 parts by mass of the polymerizable monomer, the image density of a black toner thus produced may decrease. When the content of the carbon black is more than 10 parts by mass, the electrical resistance of the thus-produced black toner may decrease.

The content of the carbon black in the polymerizable monomer composition is more preferably from 4 to 9.5 parts by mass, and still more preferably from 6 to 9 parts by mass, with respect to 100 parts by mass of the polymerizable monomer.

The number average primary particle diameter of the carbon black used in the production method of the present invention, is preferably from 10 to 100 nm. When the number average primary particle diameter of the carbon black is less than 10 nm, the dispersibility of the thus-produced black toner may decrease. When the content of the carbon black is more than 100 nm, the color properties of the thus-produced black toner may decrease.

The number average primary particle diameter of the carbon black used in the production method of the present invention is more preferably from 15 to 90 nm, and still more preferably from 20 to 70 nm.

The number average primary particle diameter of the carbon black can be measured by means of a particle size analyzer (product name: SALD, manufactured by: Shimadzu Corporation), for example.

The DBP absorption of the carbon black used in the production method of the present invention, is preferably from 10 to 100 $cm^3$/100 g. When the DBP absorption of the carbon black is less than 10 $cm^3$/100 g, the dispersibility of the thus-produced black toner may decrease. When the DBP absorption of the carbon black is more than 100 $cm^3$/100 g, the electrical resistance of the thus-produced black toner may decrease.

The DBP absorption of the carbon black used in the production method of the present invention, is more preferably from 20 to 90 $cm^3$/100 g, and still more preferably from 30 to 80 $cm^3$/100 g.

The DBP absorption of the carbon black can be measured in conformity with JIS K6221.

The carbon black may be a commercially-available product.

As the carbon black that meets the above-described number average primary particle diameter and DBP absorption conditions, examples include, but are not limited to, carbon black (product name: #25B, manufactured by: Mitsubishi Chemical Corporation, number average primary particle diameter: 40 nm, DBP absorption: 64 $cm^3$/100 g), carbon black (product name: #44B, manufactured by: Mitsubishi Chemical Corporation, number average primary particle diameter: 24 nm, DBP absorption: 78 $cm^3$/100 g), carbon black (product name: Regal 99R, manufactured by: Cabot Corporation, pH: 9, number average primary particle diameter: 38 nm, DBP absorption: 65 $cm^3$/100 g), carbon black (product name: #45, manufactured by: Mitsubishi Chemical Corporation, pH: 8, number average primary particle diameter: 24 nm, DBP absorption: 53 $cm^3$/100 g), carbon black (product name: Printex G, manufactured by: Degussa, pH: 9, number average primary particle diameter:

51 nm, DBP absorption: 96 $cm^3$/100 g), carbon black (product name: Monarch 120, manufactured by: Cabot Corporation, pH: 8, number average primary particle diameter: 75 nm, DBP absorption: 72 $cm^3$/100 g), carbon black (product name: #5, manufactured by: Mitsubishi Chemical Corporation; pH: 8, number average primary particle diameter: 85 nm, DBP absorption: 71 $cm^3$/100 g) and carbon black (product name: #2300, manufactured by: Mitsubishi Chemical Corporation, pH: 8, number average primary particle diameter: 15 nm, DBP absorption: 65 $cm^3$/100 g).

These carbon black products may be used alone or in combination of two or more kinds.

In the production method of the present invention, a softening agent is incorporated in the polymerizable monomer composition. In the present invention, the softening agent is an additive that increases low-temperature fixability. In the present invention, an ester wax and/or a hydrocarbon wax is preferably incorporated as the softening agent. By using the waxes as the softening agent, the balance between low-temperature fixability and heat-resistant storage stability can be improved.

In the present invention, the softening agent is preferably an ester wax and more preferably a polyfunctional ester wax. As the polyfunctional ester wax, examples include, but are not limited to, pentaerythritol ester compounds such as pentaerythritol tetrapalmitate, pentaerythritol tetrabehenate and pentaerythritol tetrastearate; glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate and glycerin tribehenate; and dipentaerythritol ester compounds such as dipentaerythritol hexamyristate and dipentaerythritol hexapalmitate.

The amount of the ester wax is preferably from 2 to 10 parts by mass, and more preferably from 2 to 7 parts by mass, with respect to 100 parts by mass of the polymerizable monomer.

The melting point of the ester wax is generally from 50 to 90° C., preferably from 60 to 85° C., and more preferably from 65 to 75° C.

The amount of the hydrocarbon wax is preferably from 0.5 to 8 parts by mass, more preferably from 1 to 5 parts by mass, with respect to 100 parts by mass of the polymerizable monomer.

The melting point of the hydrocarbon wax is generally from 40 to 100° C., preferably from 50 to 80° C., and more preferably from 60 to 75° C.

Besides the above softening agents, for example, a natural wax such as jojoba and a mineral wax such as ozokerite can be used.

As the softening agent, these waxes may be used alone or in combination of two or more kinds.

The total content of the softening agent is preferably from 1 to 25 parts by mass, and more preferably from 1 to 20 parts by mass, with respect to 100 parts by mass of the polymerizable monomer.

In the present invention, as the charge control agent incorporated in the polymerizable monomer composition, a sulfonic acid group-containing copolymer which is obtained by copolymerizing a vinyl aromatic hydrocarbon, a (meth) acrylate and a sulfonic acid group-containing (meth)acrylamide, is used. The sulfonic acid group-containing copolymer may be a charge control resin. By copolymerizing the sulfonic acid group-containing (meth)acrylamide, sulfonic acid groups are incorporated in the copolymer. Therefore, the sulfonic acid group-containing copolymer can be used as a negatively chargeable charge control agent. The copolymerization ratio of a sulfonic acid group-containing (meth) acrylamide monomer unit in the sulfonic acid group-containing copolymer is needed to be in a range of from 0.8 to 4.0% by mass, preferably in a range of from 1.0 to 3.5% by mass, and more preferably in a range of from 1.5 to 3.0% by mass. When the copolymerization ratio of the sulfonic acid group-containing (meth)acrylamide is less than 0.8% by mass, the effect of imparting negative chargeability is small. On the other hand, when the copolymerization ratio is more than 4.0% by mass, the dispersion stability of the droplets of the polymerizable monomer composition decreases at the time of polymerization, and a polymerization toner with a uniform particle diameter cannot be obtained. Even when the copolymerization ratio of the sulfonic acid group-containing (meth)acrylamide is too small or too large, the environmental stability of image quality deteriorates.

In the present invention, "sulfonic acid group" includes salts thereof (sulfonic acid salt groups).

For the copolymerization ratio (% by mass) of the sulfonic acid group-containing (meth)acrylamide monomer unit in the sulfonic acid group-containing copolymer, in the case of synthesizing and using the sulfonic acid group-containing copolymer, the copolymerization ratio can be a so-called amount ratio, that is, a value obtained by dividing the mass of the sulfonic acid group-containing (meth)acrylamide used, by the total mass of the vinyl aromatic hydrocarbon used, the (meth)acrylate used and the sulfonic acid group-containing (meth)acrylamide used.

In the case where an existing sulfonic acid group-containing copolymer is used and the amount composition is not clear, for example, the content of sulfur in the existing sulfonic acid group-containing copolymer is measured by elemental analysis such as fluorescent X-ray analysis (XRF), and from the thus-obtained results, the copolymerization ratio (% by mass) of the sulfonic acid group-containing (meth)acrylamide monomer unit can be calculated.

By copolymerizing the vinyl aromatic hydrocarbon, the sulfonic acid group-containing copolymer can be stably obtained. By controlling the copolymerization ratio of the vinyl aromatic hydrocarbon to the (meth)acrylate, the glass transition temperature (Tg) of the sulfonic acid group-containing copolymer can be controlled in a desired range. Therefore, the fixing temperature of the negatively chargeable toner can be relatively low, without impairing the heat-resistant storage stability thereof. By combining the vinyl aromatic hydrocarbon with the (meth)acrylate and using the combination, compatibility between the sulfonic acid group-containing copolymer and the polymer components of the polymerization toner can be increased and, therefore, the polymerization toner that is uniform in chargeability and other properties can be obtained. The copolymerization ratio (by mass) of the vinyl aromatic hydrocarbon to the (meth)acrylate is generally from 99:1 to 50:50, and preferably from 95:5 to 70:30.

The weight average molecular weight (Mw) of the sulfonic acid group-containing copolymer used in the production method of the present invention, is a polystyrene equivalent molecular weight measured by gel permeation chromatography (GPC) using tetrahydrofuran. It is preferably in a range of from 5,000 to 30,000, more preferably in a range of from 8,000 to 25,000, and still more preferably in a range of from 10,000 to 20,000. When the weight average molecular weight of the sulfonic acid group-containing copolymer is too large, the size of the droplets of the polymerizable monomer composition becomes non-uniform at the time of polymerization, and it is difficult to obtain a polymerization toner with a uniform particle diameter.

Moreover, the flowability or heat-resistant storage stability of the toner shows a downward tendency; the environmental dependency or durability of image quality deteriorates; and it is difficult to decrease the fixing temperature of the toner. When the weight average molecular weight of the sulfonic acid group-containing copolymer is too small, the flowability of the polymerization toner thus obtained is insufficient; the heat-resistant storage stability of the toner decreases; and the environmental dependency or durability of image quality shows a tendency to deteriorate.

Hereinafter, the raw materials and the production method of the sulfonic acid group-containing copolymer used in the present invention, will be described in detail.

The vinyl aromatic hydrocarbon used in the production of the sulfonic acid group-containing copolymer is a compound (monomer) having a structure that a vinyl group is bound to an aromatic hydrocarbon. As the vinyl aromatic hydrocarbon, examples include, but are not limited to, styrene, α-methylstyrene, 2-methylstyrene, 3-methylstyrene, 4-methylstyrene, 2-ethylstyrene, 3-ethylstyrene, 4-ethylstyrene, 2-propylstyrene, 3-propylstyrene, 4-propylstyrene, 2-isopropylstyrene, 3-isopropylstyrene, 4-isopropylstyrene, 2-chlorostyrene, 3-chlorostyrene, 4-chlorostyrene, 2-methyl-α-methylstyrene, 3-methyl-α-methylstyrene, 4-methyl-α-methylstyrene, 2-ethyl-α-methylstyrene, 3-ethyl-α-methylstyrene, 4-ethyl-α-methylstyrene, 2-propyl-α-methylstyrene, 3-propyl-α-methylstyrene, 4-propyl-α-methylstyrene, 2-isopropyl-α-methylstyrene, 3-isopropyl-α-methylstyrene, 4-isopropyl-α-methylstyrene, 2-chloro-α-methylstyrene, 3-chloro-α-methylstyrene, 4-chloro-α-methylstyrene, 2,3-dimethylstyrene, 3,4-dimethylstyrene, 2,4-dimethylstyrene, 2,6-dimethylstyrene, 2,3-diethylstyrene, 3,4-diethylstyrene, 2,4-diethylstyrene, 2,6-diethylstyrene, 2-methyl-3-ethylstyrene, 2-methyl-4-ethylstyrene, 2-chloro-4-methylstyrene, 2,3-dimethyl-α-methylstyrene, 3,4-dimethyl-α-methylstyrene, 2,4-dimethyl-α-methylstyrene, 2,6-dimethyl-α-methylstyrene, 2,3-diethyl-α-methylstyrene, 3,4-diethyl-α-methylstyrene, 2,4-diethyl-α-methylstyrene, 2,6-diethyl-α-methylstyrene, 2-ethyl-3-methyl-α-methylstyrene, 2-methyl-4-propyl-α-methylstyrene, and 2-chloro-4-ethyl-α-methylstyrene. These vinyl aromatic hydrocarbons can be used alone or in combination of two or more kinds.

The (meth)acrylate used in the production of the sulfonic acid group-containing copolymer is an acrylic ester or methacrylic ester. As the (meth)acrylate, examples include, but are not limited to, the following compounds: acrylic esters such as methyl acrylate, ethyl acrylate, propyl acrylate, isopropyl acrylate, n-butyl acrylate, isobutyl acrylate, n-amyl acrylate, isoamyl acrylate, n-hexyl acrylate, 2-ethylhexyl acrylate, hydroxypropyl acrylate and lauryl acrylate, and methacrylic esters such as methyl methacrylate, ethyl methacrylate, propyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, hydroxypropyl methacrylate and lauryl methacrylate. These (meth)acrylates can be used alone or in combination of two or more kinds.

As the sulfonic acid group-containing (meth)acrylamide used in the production of the sulfonic acid group-containing copolymer, examples include, but are not limited to, 2-acrylamido-2-methylpropanesulfonate, 2-acrylamido-n-butanesulfonate, 2-acrylamido-n-hexanesulfonate, 2-acrylamido-n-octanesulfonate, 2-acrylamido-n-dodecanesulfonate, 2-acrylamido-n-tetradecanesulfonate, 2-acrylamido-2-methylpropanesulfonate, 2-acrylamido-2-phenylpropanesulfonate, 2-acrylamido-2,2,4-trimethylpentanesulfonate, 2-acrylamido-2-methylphenylethanesulfonate, 2-acrylamido-2-(4-chlorophenyl)propanesulfonate, 2-acrylamido-2-carboxymethylpropanesulfonate, 2-acrylamido-2-(2-pyridine)propanesulfonate, 2-acrylamido-1-methylpropanesulfonate, 3-acrylamido-3-methylbutanesulfonate, 2-methacrylamido-n-decanesulfonate, and 4-methacrylamidobenzenesulfonate. These sulfonic acid group-containing (meth)acrylamides can be used alone or in combination of two or more kinds.

The sulfonic acid group-containing copolymer used in the production method of the present invention, can be obtained by copolymerizing the monomer components by a desired polymerization method such as emulsion polymerization, dispersion polymerization, suspension polymerization or solution polymerization. Among the polymerization methods, the solution polymerization method is preferred from the point of view that it makes easy to control the copolymerization ratio and the weight average molecular weight. As the polymerization initiator used in the production of the sulfonic acid group-containing copolymer, examples include, but are not limited to, azo compounds such as 2,2'-azobisisobutyronitrile, 2,2'-azobis(2,4-dimethylvaleronitrile), 2,2'-azobis(4-methoxy-2,4-dimethylvaleronitrile), 2,2'-azobisisobutyrate, 4,4'-azobis(4-cyanopentanoic acid), 4,4'-azobis(4-cyanovaleric acid), 2,2'-azobis(2-amidinopropane)dibasic acid, 2,2-azobis-2-methyl-N-1,1-bis(hydroxymethyl)-2-hydroxydiethylpropionamide, and 1,1'-azobis(1-cyclohexanecarbonitrile); diamine compounds such as 2,2'-azobis(2-amidinopropane)dihydrochloride, 2,2'-azobis(N,N'-dimethyleneisobutyramidine), and 2,2'-azobis(N,N'-dimethyleneisobutyramidine)dihydrochloride; and peroxides such as methylethyl peroxide, di-t-butyl peroxide, acetyl peroxide, dicumyl peroxide, lauroyl peroxide, benzoyl peroxide, t-butylperoxy-2-ethylhexanoate, di-isopropyl peroxydicarbonate, and di-t-butylperoxy isophthalate.

The amount of the polymerization initiator used can be appropriately selected, depending on the target weight average molecular weight. It is generally from 0.01 to 10 parts by mass, and preferably from 0.1 to 5 parts by mass, with respect to the total amount (100 parts by mass) of the monomers. In the solution polymerization, an anionic polymerization initiator such as an alkali metal, butyllithium or a reaction product of an alkali metal and naphthalene can be used.

A solvent and a dispersant are used in the solution polymerization or the like, and they can be appropriately selected from hydrocarbon compounds and oxygen-containing organic compounds. As the hydrocarbon compounds, examples include, but are not limited to, aromatic hydrocarbon compounds such as benzene, toluene and xylene, and saturated hydrocarbon organic compounds such as n-hexane, cyclohexane, methylcyclohexane, ethylcyclohexane, nonane, decane, decalin and dodecane. As the oxygen-containing organic compounds, examples include, but are not limited to, compounds having a hydroxyl group, such as methanol, ethanol, n-propyl alcohol, isopropyl alcohol, n-butyl alcohol, isobutyl alcohol, secondary butyl alcohol, amyl alcohol, isoamyl alcohol, methyl isobutyl carbinol, 2-ethylbutanol, 2-ethylhexanol, cyclohexanol, furfuryl alcohol, tetrahydrofurfuryl alcohol, ethylene glycol, hexylene glycol and glycerin; aliphatic saturated ethers such as propyl ether, isopropyl ether, butyl ether, isobutyl ether, n-amyl ether, isoamyl ether, methylbutyl ether, methyl isobutyl ether, methyl n-amyl ether, methyl isoamyl ether, ethyl propyl ether, ethyl isopropyl ether, ethyl butyl ether, ethyl isobutyl ether, ethyl n-amyl ether and ethyl isoamyl ether; aliphatic unsaturated ethers such as allyl ether and ethylallyl ether; aromatic ethers such as anisole, phenetole, phenyl ether and benzyl ether; cyclic ethers such as tetrahydrofuran, tetrahydropyran and dioxane; ethylene glycols such as ethylene glycol monomethyl ether, ethylene glycol monoethyl ether, ethylene glycol monobutyl ether, diethylene glycol monomethyl ether, diethylene glycol monoethyl ether, and diethylene glycol monobutyl ether; organic acids such as formic acid, acetic acid, acetic anhydride and butyric acid; organic acid esters such as butyl formate, amyl formate, propyl acetate, isopropyl acetate, butyl acetate, sec-butyl acetate, amyl acetate, isoamyl acetate, 2-ethylhexyl acetate, cyclohexyl acetate, butylcyclohexyl acetate, ethyl propionate, butyl propionate, amyl propionate, butyl butyrate, diethyl carbonate, diethyl oxalate, methyl lactate, ethyl lactate, butyl lactate and triethyl phosphate; ketones such as methyl isopropyl ketone, methyl isobutyl ketone, ethyl isobutyl ketone, diisobutyl ketone, acetylacetone, diacetone alcohol, cyclohexanone, cyclopentanone, methylcyclohexanone and cycloheptanone; and other oxygen-containing organic compounds such as 1,4-dioxane, isophorone and furfural.

The polymerization temperature and the polymerization time can be appropriately selected, depending on the polymerization method and the type of the polymerization initiator used. In general, the polymerization temperature is about from 50 to 200° C., and the polymerization time is about from 0.5 to 20 hours. In the polymerization, a commonly known additive (for example, a polymerization aid such as amine) can be used in combination. To collect the sulfonic acid group-containing copolymer from the system after the polymerization, for example, the following methods can be used: a method of precipitating the copolymer by adding a poor solvent, a method of removing the solvent by steam, a method of removing the solvent by reduced pressure, a method of removing the solvent by heating and melting, a method of freeze-drying the system, a method of polymerizing the sulfonic acid group-containing copolymer at a high concentration and adding the copolymer as it is to the toner polymerization system In the production method of the present invention, the amount of the charge control agent incorporated in the polymerizable monomer composition is generally from 0.1 to 8.0 parts by mass, preferably from 0.2 to 5.0 parts by mass, and still more preferably from 0.3 to 3.0 parts by mass, with respect to 100 parts by mass of the polymerizable monomer (preferably the monovinyl monomer). When the amount of the charge control agent is less than 0.1 part by mass, the toner is insufficiently charged and may cause fog. On the other hand, when the amount of the charge control agent is more than 8.0 parts by mass, fog may occur in a low temperature and low humidity environment.

As another additive, a molecular weight modifier is preferably used in the polymerization of the polymerizable monomer that is polymerized into a binder resin.

The molecular weight modifier is not particularly limited, as long as it is one that is generally used as a molecular weight modifier for toners. As the molecular weight modifier, examples include, but are not limited to, mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier is generally from 0.01 to 10 parts by mass, and preferably from 0.1 to 5 parts by mass, with respect to 100 parts by mass of the monovinyl monomer.

In the production method of the present invention, aggregation of the carbon black in the polymerizable monomer composition can be prevented by adding an aluminum coupling agent solely to the polymerizable monomer composition and mixing them before the polymerizable monomer composition is formed into droplets in the aqueous dispersion medium. Since there is no need for a pretreatment (i.e., a coupling treatment of the colorant), the negatively chargeable toner can be efficiently produced.

The aluminum coupling agent used in the production method of the present invention may be one that is generally used in the art. As the aluminum coupling agent, examples include, but are not limited to, an aluminum alcoholate, an aluminum chelate and a cyclic aluminum oligomer. Of them, preferred is an aluminum alcoholate such as acetoalkoxy aluminum diisopropylate as typified by "Plenact AL-M" (product name, manufactured by: Ajinomoto Fine-Techno. Co., Inc.) having the structure represented by the following formula:

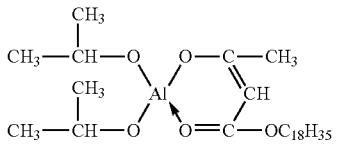

In the production method of the present invention, the amount of the aluminum coupling agent incorporated in the polymerizable monomer composition is preferably from 0.01 to 1.0 part by mass, and more preferably from 0.05 to 0.8 part by mass, with respect to 100 parts by mass of the polymerizable monomer. Also, the amount of the aluminum coupling agent incorporated in the polymerizable monomer composition is preferably from 0.5 to 10 parts by mass, and more preferably from 1 to 5 parts by mass, with respect to 100 parts by mass of the carbon black.

When the amount of the aluminum coupling agent is smaller than the range, the effect of preventing the aggregation of the carbon black is insufficient.

On the other hand, when the amount of the aluminum coupling agent is larger than the range, the droplets of the polymerizable monomer composition aggregate easily and increase coarse colored resin particles.

(2) Suspension Step of Obtaining Suspension (Droplets Forming Step)

In the present invention, the polymerizable monomer composition containing at least the polymerizable monomer, the carbon black, the softening agent and the charge control agent is dispersed in an aqueous dispersion medium containing a dispersion stabilizer, and a polymerization initiator is added therein. Then, the polymerizable monomer composition are formed into droplets. The method for forming the droplets is not particularly limited. For example, the droplets are formed by means of a device capable of strong agitation, such as an (in-line type) emulsifying and dispersing machine (product name: Milder, manufactured by: Pacific Machinery & Engineering Co., Ltd.) and a high-speed emulsifying and dispersing machine (product name: T. K. Homomixer Mark II, manufactured by: PRIMIX Corporation).

As the polymerization initiator, examples include, but are not limited to, persulfates such as potassium persulfate and ammonium persulfate; azo compounds such as 4,4'-azobis (4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-butylperoxy diethylacetate, t-hexylperoxy-2-ethylbutanoate, diisopropylperoxydicarbonate, di-t-butylperoxyisophthalate and t-butylperoxyisobutyrate. They can be used alone or in combination of two or more kinds. Of them, organic peroxides are preferred since they can reduce residual polymerizable monomer and impart excellent printing durability.

Among organic peroxides, peroxy esters are preferred, and non-aromatic peroxy esters, i.e., peroxy esters having no aromatic ring, are more preferred since they have excellent initiator efficiency and can reduce residual polymerizable monomer.

As described above, the polymerization initiator may be added after the polymerizable monomer composition is dispersed in the aqueous dispersion medium and before the polymerizable monomer composition is formed into droplets, or it may be added to the polymerizable monomer composition before the polymerizable monomer composition is dispersed into the aqueous dispersion medium.

The added amount of the polymerization initiator used for the polymerization of the polymerizable monomer composition, is preferably from 0.1 to 20 parts by mass, more preferably from 0.3 to 15 parts by mass, and even more preferably from 1 to 10 parts by mass, with respect to 100 parts by mass of the polymerizable monomer.

In the present invention, the aqueous dispersion medium means a medium containing water as a main component.

In the production method of the present invention, the dispersion stabilizer is preferably added to the aqueous dispersion medium. As the dispersion stabilizer, examples include, but are not limited to, inorganic compounds including: sulfates such as barium sulfate and calcium sulfate, carbonates such as barium carbonate, calcium carbonate and magnesium carbonate, phosphates such as calcium phosphate, metal oxides such as aluminum oxide and titanium oxide, and metal hydroxides such as aluminum hydroxide, magnesium hydroxide and iron(II) hydroxide; and organic compounds including: water-soluble polymers such as polyvinyl alcohol, methyl cellulose and gelatin, anionic surfactants, nonionic surfactants, and ampholytic surfactants. These dispersion stabilizers can be used alone or in combination of two or more kinds.

Among the above dispersion stabilizers, preferred are colloids of inorganic compounds, and particularly preferred is a colloid of a hardly water-soluble metal hydroxide. By using a colloid of an inorganic compound, particularly a colloid of a hardly water-soluble metal hydroxide, the colored resin particles can have a small particle size distribution, and the amount of the dispersion stabilizer remaining after washing can be small, so that the toner thus obtained can clearly reproduce an image and has excellent environmental stability.

2. Step of Obtaining Colored Resin Particles (1) Suspension Polymerization Step

In the production method of the present invention, the formation of the droplets is carried out as described above under "1. Suspension step". The thus-obtained suspension, that is, the aqueous dispersion medium is heated to polymerize, thereby forming an aqueous dispersion of colored resin particles.

The polymerization temperature of the polymerizable monomer composition is preferably 50° C. or more, and more preferably from 60 to 95° C. The polymerization reaction time is preferably from 1 to 20 hours, and more preferably from 2 to 15 hours.

The colored resin particles may be used as they are as a polymerization toner, or they may be mixed with an external additive and used as a polymerization toner. It is preferable that the colored resin particles are so-called core-shell type (or "capsule type") colored resin particles obtained by using the colored resin particles as a core layer and forming a shell layer, which is a layer that is different from the core layer, around the core layer. By covering the core layer composed of a substance having a low softening point with a substance having a higher softening point, the core-shell type colored resin particles can achieve a balance between lowering of fixing temperature and prevention of aggregation during storage.

A method for producing the above-mentioned core-shell type colored resin particles using the colored resin particles, is not particularly limited. The core-shell type colored resin particles can be produced by a conventional method. The in situ polymerization method and the phase separation method are preferable from the viewpoint of production efficiency.

Hereinafter, a method for producing the core-shell type colored resin particles by the in situ polymerization method, will be described.

The core-shell type colored resin particles can be obtained by adding a polymerizable monomer for forming a shell layer (a polymerizable monomer for shell) and a polymerization initiator to the aqueous dispersion medium in which the colored resin particles are dispersed, and then polymerizing the mixture.

As the polymerizable monomer for shell, the above-mentioned polymerizable monomers can be used. Among the polymerizable monomers, it is preferable to use monomers that can provide a polymer having a Tg of more than 80° C., such as styrene, acrylonitrile and methyl methacrylate, alone or in combination of two or more kinds.

As the polymerization initiator used for polymerization of the polymerizable monomer for shell, examples include, but are not limited to, water-soluble polymerization initiators including metal persulfates such as potassium persulfate and ammonium persulfate, and azo-type initiators such as 2,2'-azobis(2-methyl-N-(2-hydroxyethyl)propionamide) and 2,2'-azobis(2-methyl-N-(1,1-bis(hydroxymethyl)2-hydroxyethyl)propionamide). These polymerization initiators can be used alone or in combination of two or more kinds. The amount of the polymerization initiator is preferably from 0.1 to 30 parts by mass, and more preferably from 1 to 25 parts by mass, with respect to 100 parts by mass of the polymerizable monomer for shell.

The polymerization temperature of the shell layer is preferably 50° C. or more, and more preferably from 60 to 95° C. The polymerization reaction time is preferably from 1 to 20 hours, and more preferably from 2 to 15 hours.

(2) Washing, Filtering, Dehydrating and Drying Steps

After the polymerization is completed, the aqueous dispersion of the colored resin particles obtained by the polymerization is preferably subjected to operations of filtering, washing for removal of the dispersion stabilizer, dehydrating and drying, several times as needed, according to a conventional method.

In the washing method, when the inorganic compound is used as the dispersion stabilizer, it is preferable to add acid or alkali to the aqueous dispersion of the colored resin particles, thereby dissolving the dispersion stabilizer in water and removing it. When the colloid of the hardly water-soluble inorganic hydroxide is used as the dispersion stabilizer, it is preferable to control the pH of the aqueous dispersion of the colored resin particles to 6.5 or less by adding acid. As the acid, examples include, but are not limited to, inorganic acids such as sulfuric acid, hydrochloric acid and nitric acid, and organic acids such as formic acid and acetic acid. Especially, sulfuric acid is suitable for its high removal efficiency and small impact on production facilities.

The dehydrating and filtering method is not particularly limited and can be selected from various known methods. As the method, examples include, but are not limited to, a centrifugal filtration method, a vacuum filtration method and a pressure filtration method. Also, the drying method is not particularly limited and can be selected from various methods.

3. Colored Resin Particles Thus Obtained

The colored resin particles are obtained by the above-described suspension polymerization method.

Hereinafter, the colored resin particles constituting the toner will be described. The colored resin particles described below encompass both core-shell type colored resin particles and colored resin particles of other types.

The volume average particle diameter (Dv) of the colored resin particles is preferably from 4 to 12 μm, and more preferably from 5 to 10 μm. When the volume average particle diameter (Dv) is less than 4 μm, toner flowability decreases and may deteriorate transferability or decrease image density. When the volume average particle diameter (Dv) is more than 12 μm, image resolution may decrease.

For the colored resin particles, the ratio (Dv/Dn) of the volume average particle diameter (Dv) and the number average particle diameter (Dn) is preferably from 1.0 to 1.3, and more preferably from 1.0 to 1.2. When the ratio Dv/Dn is more than 1.3, there may be a decrease in transferability, image density and resolution. The volume average particle diameter and number average particle diameter of the colored resin particles can be measured by means of a particle size analyzer (product name: Multisizer, manufactured by: Beckman Coulter, Inc.), for example.

In the present invention, as just described, a negatively chargeable toner is obtained, which has a narrow particle size distribution even though it is produced by the polymerization method.

The average circularity of the colored resin particles of the present invention is preferably from 0.96 to 1.00, more preferably from 0.97 to 1.00, and even more preferably from 0.98 to 1.00, from the viewpoint of image reproducibility.

When the average circularity of the colored resin particles is less than 0.96, thin line reproducibility in printing may deteriorate.

In the present invention, "circularity" is defined as a value obtained by dividing the perimeter of a circle having the same area as the projected area of a particle image by the perimeter of the particle image. Also in the present invention, "average circularity" is used as a simple method for quantitatively representing the shape of the particles and is an indicator that shows the degree of the surface roughness of the colored resin particles. The average circularity is 1 when the colored resin particles are perfectly spherical, and it gets smaller as the surface shape of the colored resin particles becomes more complex.

4. Step of Producing Toner from Colored Resin Particles

In the production method of the present invention, the colored resin particles can be used as they are as a toner. However, it is preferable that the colored resin particles are mixed and stirred with an external additive to attach the external additive to the surface of the colored resin particles, thereby obtaining a one-component toner (developer). The one-component toner may be mixed and stirred with carrier particles to obtain a two-component developer.

An agitator is used to cover the colored resin particles with the external additive. The agitator is not particularly limited, as long as it is an agitating device that can attach the external additive to the surface of the colored resin particles. For example, the colored resin particles can be covered with the external additive by means of an agitator that is capable of mixing and agitation, such as FM Mixer (product name, manufactured by: Nippon Coke & Engineering Co., Ltd.), Super Mixer (product name, manufactured by: Kawata Manufacturing Co., Ltd.), Q Mixer (product name, manufactured by: Nippon Coke & Engineering Co., Ltd.), Mechanofusion System (product name, manufactured by: Hosokawa Micron Corporation) and Mechanomill (product name, manufactured by: Okada Seiko Co., Ltd.)

As the external additive, examples include, but are not limited to, inorganic fine particles of silica, titanium oxide, aluminum oxide, zinc oxide, tin oxide, calcium carbonate, calcium phosphate and/or cerium oxide, and organic fine particles of polymethyl methacrylate resin, silicone resin and/or melamine resin. Of them, inorganic fine particles are preferred. Of inorganic fine particles, inorganic fine particles of silica and/or titanium oxide are preferred, and inorganic fine particles of silica are particularly preferred.

These external additives can be used alone or in combination of two or more kinds. It is particularly preferable to use two or more kinds of silica particles different in particle diameter.

In the present invention, the amount of the external additive is generally from 0.05 to 6 parts by mass, and preferably from 0.2 to 5 parts by mass, with respect to 100 parts by mass of the colored resin particles. When the amount of the external additive added is less than 0.05 part by mass, toner transferability may lower. When the amount of the external additive added is more than 6 parts by mass, fog may occur.

5. Toner Obtained by the Production Method of the Present Invention

The toner obtained through the above steps is a negatively chargeable toner in which the carbon black (as a colorant) is well dispersed and which has high chargeability, has excellent transfer efficiency, prevents a white spot and provides an image with sufficient image density.

By the preparation of the polymerizable monomer composition by mixing the polymerizable monomer, the carbon black, the softening agent, the aluminum coupling agent, and the charge control agent that is the copolymer in which the copolymerization ratio of the sulfonic acid group-containing (meth)acrylamide monomer unit is within the specific range, the negatively chargeable toner of the present invention can be obtained. The negatively chargeable toner is a toner that the toner charge amount is kept high by the charge control agent, and the aggregation of the carbon black is prevented by the mixing with the aluminum coupling agent.

EXAMPLES

Hereinafter, the present invention will be described further in detail, with reference to examples and comparative examples. However, the scope of the present invention may not be limited to the following examples. Herein, "part(s)" and "%" are based on mass if not particularly mentioned.

Test methods used in the examples and the comparative examples are as follows.

1. Production of Sulfonic Acid Group-Containing Copolymer (Charge Control Agent)

Production Example (1-1)

First, 900 parts of toluene, 83 parts of styrene, 14.5 parts of 2-ethylhexyl acrylate, 2.5 parts of 2-acrylamido-2-methylpropanesulfonate, and 2.4 parts of 2,2'-azobis(2,4-dimethylvaleronitrile) were put in a 3 L reaction container. While agitating the mixture, the mixture was subjected to a copolymerization reaction for 8 hours at 80° C. After the reaction was completed, the solvent was removed by freeze-drying, thereby obtaining a charge control agent which had a weight average molecular weight of 18,000 and a glass transition temperature of 56.2° C. and in which the copolymerization ratio of the sulfonic acid group-containing (meth)acrylamide monomer unit was 2.5% by mass.

Production Example (1-2)

The charge control agent of Production Example (1-2) which had a weight average molecular weight of 18,000 and a glass transition temperature of 57.6° C. and in which the copolymerization ratio of the sulfonic acid group-containing (meth)acrylamide monomer unit was 7.0% by mass, was obtained in the same manner as Production Example (1-1), except that the amounts of the monomers used for the copolymerization were changed to the following: 78.5 parts of styrene, 14.5 parts of 2-ethylhexyl acrylate, and 7 parts of 2-acrylamido-2-methylpropanesulfonate.

Production Example (1-3)

The charge control agent of Production Example (1-3) which had a weight average molecular weight of 18,000 and a glass transition temperature of 56.0° C. and in which the copolymerization ratio of the sulfonic acid group-containing (meth)acrylamide monomer unit was 1.2% by mass, was obtained in the same manner as Production Example (1-1), except that the amount of the monomers used for the copolymerization were changed to the following: 84.3 parts of styrene, 14.5 parts of 2-ethylhexyl acrylate, and 1.2 parts of 2-acrylamido-2-methylpropanesulfonate.

2. Production of Negatively Chargeable Toner

Example 1

First, 77 parts of styrene and 23 parts of n-butyl acrylate as polymerizable monomers, 0.25 part of an aluminum coupling agent (product name: Plenact AL-M, manufactured by: Ajinomoto Fine-Techno. Co., Inc.) and 9 parts of a carbon black (product name: #25B, manufactured by: Mitsubishi Chemical Corporation) were dispersed by means of a disperser (product name: DYNO-MILL, manufactured by: Shinmaru Enterprises Corporation) to obtain a polymerizable monomer mixture.

Next, 2.0 parts of the sulfonic acid group-containing copolymer obtained in the Production Example (1-1) as a charge control agent, 2 parts of polyglycerin octabehenate and 5 parts of paraffin wax as softening agents, 0.3 part of a polymethacrylic acid ester macromonomer (product name: AA6, manufactured by: Toagosei Co., Ltd.) as a macromonomer, 0.7 part of divinylbenzene as a crosslinkable polymerizable monomer, and 1.5 parts of t-dodecyl mercaptan as a molecular weight modifier, were added, mixed and then dissolved in the polymerizable monomer mixture to prepare a polymerizable monomer composition.

Separately, an aqueous solution of 9.7 parts of sodium hydroxide dissolved in 50 parts of ion-exchanged water, was gradually added to an aqueous solution of 13.9 parts of magnesium chloride dissolved in 250 parts of ion-exchanged water, while agitating at room temperature, to prepare a magnesium hydroxide colloid (hardly water-soluble metal hydroxide colloid) aqueous dispersion.

The polymerizable monomer composition was added to the magnesium hydroxide colloid dispersion and agitated at room temperature. Then, with respect to 100 parts by mass of the polymerizable monomer, 4.0 parts of a polymerization initiator (product name: Perbutyl 0, manufactured by: NOF Corporation) was added thereto. The resulting mixture was subjected to high shear agitation at 15,000 rpm for one minute, using an in-line type emulsifying and dispersing machine (Product name: Cavitron, manufactured by: Pacific Machinery & Engineering Co., Ltd.), thereby forming fine droplets of the polymerizable monomer composition in the aqueous dispersion medium. Therefore, an aqueous dispersion in which the droplets of the polymerizable monomer composition were dispersed, was prepared.

The suspension in which the droplets of the polymerizable monomer composition were dispersed (a polymerizable monomer composition dispersion) was put in a reactor furnished with agitating blades, and the temperature thereof was raised to 90° C. to start a polymerization reaction. When the polymerization conversion rate reached almost 100%, 2 parts of methyl methacrylate (a polymerizable monomer for shell) and 0.5 part of 2,2'-azobis (2-methyl-N-(2-hydroxyethyl)-propionamide) (a polymerization initiator for shell) dissolved in 10 parts of ion-exchanged water, were added thereto. The reaction was continued for 3 hours at 90° C. and then stopped by water-cooling the reactor, thereby obtaining an aqueous dispersion of colored resin particles having a core-shell structure.

The aqueous dispersion of the colored resin particles was subjected to acid washing in the following manner: while the aqueous dispersion was agitated, sulfuric acid was added thereto in a dropwise manner at room temperature, until the pH of the aqueous dispersion reached 6.5 or less. Then, the aqueous dispersion was subjected to filtration separation. A solid thus obtained was re-slurried with 500 parts of ion-exchanged water, and a water washing treatment (washing, filtration and dehydration) was carried out thereon several times. Next, filtration separation was carried out thereon to obtain a solid, and the solid was placed in the container of a dryer and dried at 40° C. for 24 hours, thereby obtaining core-shell type colored resin particles having a volume average particle diameter (Dv) of 6.6 μm and a particle size distribution (Dv/Dn) of 1.19.

To 100 parts of the dried colored resin particles, 1.0 part of a hydrophobized, negatively chargeable silica having an average primary particle diameter of 40 nm (manufactured by Clariant Corp.) and 0.6 part of a hydrophobized, negatively chargeable silica having an average primary particle diameter of 12 nm (manufactured by Nippon Aerosil Co., Ltd.) were added as external additives. Using a lab-scale, high-speed agitator furnished with a cooling jacket (product name: FM Mixer, manufactured by: Nippon Coke & Engineering Co., Ltd., volume: 10 L), they were mixed and agitated at an agitating blade peripheral speed of 40 m/sec for a treatment time of 300 seconds to cover the colored resin particles with the external additives, thereby obtaining the negatively chargeable toner of Example 1.

Example 2

The negatively chargeable toner of Example 2 was obtained in the same manner as Example 1, except that the sulfonic acid group-containing copolymer of Production Example (1-1) used as the charge control agent, was changed to the sulfonic acid group-containing copolymer of Production Example (1-3), and the amount of the charge control agent added was changed to 4.5 parts. The core-shell type colored resin particles thus obtained had a volume average particle diameter (Dv) of 6.9 μm and a particle size distribution (Dv/Dn) of 1.13.

Comparative Example 1

The negatively chargeable toner of Comparative Example 1 was obtained in the same manner as Example 1, except that the aluminum coupling agent was not added, and the amount of the charge control agent added was changed to 0.8 part. The core-shell type colored resin particles thus obtained had a volume average particle diameter (Dv) of 6.8 μm and a particle size distribution (Dv/Dn) of 1.14.

Comparative Example 2

The negatively chargeable toner of Comparative Example 2 was obtained in the same manner as Comparative Example 1, except that the amount of the carbon black added was changed to 10 parts. The core-shell type colored resin particles thus obtained had a volume average particle diameter (Dv) of 6.8 μm and a particle size distribution (Dv/Dn) of 1.14.

Comparative Example 3

The negatively chargeable toner of Comparative Example 3 was obtained in the same manner as Comparative Example 1, except that the amount of the carbon black added was changed to 6 parts. The core-shell type colored resin particles thus obtained had a volume average particle diameter (Dv) of 5.9 μm and a particle size distribution (Dv/Dn) of 1.16.

Comparative Example 4

The negatively chargeable toner of Comparative Example 4 was obtained in the same manner as Comparative Example 1, except that the sulfonic acid group-containing copolymer of Production Example (1-1) used as the charge control agent, was changed to the sulfonic acid group-containing copolymer of Production Example (1-2). The core-shell type colored resin particles thus obtained had a volume average particle diameter (Dv) of 7.5 μm and a particle size distribution (Dv/Dn) of 1.27.

Comparative Example 5

The negatively chargeable toner of Comparative Example 5 was obtained in the same manner as Example 1, except that the sulfonic acid group-containing copolymer of Production Example (1-1) used as the charge control agent was changed to the sulfonic acid group-containing copolymer of Production Example (1-2). The core-shell type colored resin particles thus obtained had a volume average particle diameter (Dv) of 7.2 μm and a particle size distribution (Dv/Dn) of 1.28.

3. Evaluation of Toner Properties

The properties of the toners of Examples 1 and 2 and Comparative Examples 1 to 5 were examined. Details are as follows.

(1) Image Density

For image density measurement, a commercially-available, non-magnetic one-component development printer was used. The toner cartridge of the development device was filled with the toner. Then, printing sheets were loaded in the device.

The printer was left for 24 hours in a normal temperature and normal humidity (N/N) environment (temperature: 23° C., humidity: 50%). Then, in the same environment, printing was carried out at an image density of 5%.

Solid pattern printing (image density 100%) was carried out, and the resulting black solid image was measured for image density by means of a reflection image densitometer (product name: RD918, manufactured by: Macbeth).

<Acceptance Criterion>

In this test, for image density required of toner, the toner was evaluated as acceptable when the image density was 1.45 or more.

(2) Resistivity (Volume Resistivity Value) (log Ω/cm)

First, about 3 g of the colored resin particles were put in a tablet machine having a diameter of 5 cm. A load of about 100 kg was applied thereto for one minute to produce a test specimen. The volume resistivity value of the colored resin particles was obtained by measuring the test specimen using a dielectric loss measuring device (product name: TRS-10, manufactured by: Ando Electric Co., Ltd.) at a temperature of 30° C. and a frequency of 1 kHz.

<Acceptance Criterion>

In this test, for resistivity, the toner was evaluated as acceptable when the volume resistivity value was 10.40 (log Ω/cm) or more.

(3) Charge Amount (μC/g)

First, 9.5 g of a carrier and 0.5 g of the toner were put in a 100 cc glass bottle. The bottle was rotated for 30 minutes at a rotational frequency of 150 rpm. Then, using a blow-off meter (product name: TB-203, manufactured by: KYOCERA Chemical Corporation), the blow-off charge amount of the toner was measured by blowing nitrogen gas at a pressure of 4.5 kPa and suctioning the gas at a pressure of 9.5 kPa.

The measurement was carried out at a temperature of 23° C. and a relative humidity of 50%.

<Acceptance Criteria>

In this test, for charge amount required of toner, the toner was evaluated as acceptable when the blow-off charge amount was −20 μC/g or less.

(4) Transfer Efficiency

A commercially-available, non-magnetic one-component development printer was left for one day in a normal temperature and normal humidity (N/N) environment (temperature: 23° C., humidity: 50%). Then, sheets were continuously printed at an image density of 5% from the beginning of the printing. The amount of consumed toner and the amount of recovered waste toner were obtained every 500 sheets. The transfer efficiency of the toner was calculated by the following formula:

Transfer efficiency (%)=(the amount (g) of consumed toner−the amount (g) of recovered waste toner)/the amount (g) of consumed toner×100

<Acceptance Criteria>

In this test, for transfer efficiency required of toner, the toner was evaluated as acceptable when the transfer efficiency was 80% or more.

(5) White Spot

The commercially-available, non-magnetic one-component development printer was left for one day in a normal temperature and normal humidity (N/N) environment (temperature: 23° C., humidity: 50%). Then, sheets were continuously printed at an image density of 5% from the beginning of the printing. Every 500 sheets, solid pattern printing was carried out at an image density of 100%, and the presence of a white spot was checked.

<Acceptance Criteria>

In this test, the toner was evaluated as acceptable when a white spot was not found by visual observation.

4. Evaluation Results

Table 1 shows the amount composition at the time of production and the evaluation results of the negatively chargeable toners of Examples 1 and 2 and Comparative Example 1 to 5. In Table 1 and the following descriptions, "copolymerization ratio" means the copolymerization ratio (% by mass) of the 2-acrylamido-2-methylpropanesulfonate unit in the sulfonic acid group-containing copolymer.

TABLE 1

| | Example 1 | Example 2 | Comparative Example 1 | Comparative Example 2 | Comparative Example 3 | Comparative Example 4 | Comparative Example 5 |
|---|---|---|---|---|---|---|---|
| Styrene (part by mass) | 77 | 77 | 77 | 77 | 77 | 77 | 77 |
| Butyl acrylate (part by mass) | 23 | 23 | 23 | 23 | 23 | 23 | 23 |
| Carbon black (part by mass) | 9 | 9 | 9 | 10 | 6 | 9 | 9 |
| Aluminum coupling agent (part by mass) | 0.25 | 0.25 | 0 | 0 | 0 | 0 | 0.25 |
| Charge control agent (part by mass) | 2 | 4.5 | 0.8 | 0.8 | 0.8 | 0.8 | 2 |
| Copolymerization ratio (%) | 2.5 | 1.2 | 2.5 | 2.5 | 2.5 | 7 | 7 |
| Image density | 1.55 | 1.58 | 1.43 | 1.55 | 1.35 | 1.32 | 1.42 |
| Resistivity (logΩ/cm) | 10.91 | 10.89 | 10.32 | 10.22 | 10.71 | 10.01 | 10.62 |
| Charge amount (μC/g) | −21.3 | −20.5 | −20.3 | −16.5 | −21.5 | −23.3 | −24.1 |
| Transfer efficiency | Acceptable | Acceptable | Non-acceptable | Non-acceptable | Acceptable | Non-acceptable | Acceptable |
| White spot | No | No | Yes | Yes | No | Yes | No |

5. Conclusion

Hereinafter, the toner evaluation will be discussed with reference to Table 1.

First, the toners of Comparative Examples 1 to 3 will be discussed. According to Table 1, the toners are toners that the aluminum coupling agent was not incorporated in the polymerizable monomer composition in the production step 1.

According to Table 1, the toners of Comparative Examples 1 to 3 are different in the carbon black content. Like the toner of Comparative Example 3, in the case where the carbon black amount is as low as 6 parts, there is no problem with the resistivity, charge amount, transfer efficiency and white spot. However, the toner is rejected since the image density is low. Meanwhile, like the toners of Comparative Examples 1 and 2, by gradually increasing the carbon black amount from 9 to 10 parts, the image density of the toner can be increased. However, since the resistivity and charge amount of the toner decrease, a white spot and a deterioration in transfer efficiency are caused and result in printing failure.

From the above results, it is clear that a negatively chargeable toner that has high chargeability, has excellent transfer efficiency, prevents a white spot and provides an image with sufficient image density, cannot be produced only by controlling the amount of the carbon black incorporated in the polymerizable monomer composition.

Next, the toners of Comparative Examples 1 and 4 will be compared and discussed. According to Table 1, the toners of Comparative Examples 1 and 4 are different in the copolymerization ratio of the charge control resin used. Even in the case where the charge control resin having a high copolymerization ratio of 7% by mass was used in place of the charge control resin having a copolymerization ratio of 2.5% by mass used in Comparative Example 1, the charge amount can be improved. However, since the dispersibility of the carbon black decreases, the image density decreases.

For the toner of Example 1 that was produced by incorporating the aluminum coupling agent in the polymerizable monomer composition and using the charge control resin having a copolymerization ratio of 2.5% by mass, the image density is 1.55; the resistivity is 10.91 log Ω/cm; and the charge amount is −21.3 μC/g. Also, the toner of Example 1 does not have a problem with transfer efficiency and does not cause a white spot.

The toner of Comparative Example 5 is a toner that the charge control resin having a high copolymerization ratio of 7% by mass was used in place of the charge control resin having a copolymerization ratio of 2.5% by mass used in Example 1. As with the toner of Example 1, compared to the toners of Comparative Examples 1 to 4, the toner of Comparative Example 5 achieved a certain amount of improvement, since the aluminum coupling agent was incorporated therein. However, the dispersibility of the carbon black is not sufficient since the copolymerization ratio is 7% by mass and too high. Moreover, the image density is 1.42 and is not at an acceptable level.

For the toner of Example 2 that was produced by incorporating the aluminum coupling agent in the polymerizable monomer composition and using the charge control resin having a copolymerization ratio of 1.2% by mass, the image density is 1.58; the resistivity is 10.89 log Ω/cm; and the charge amount is −20.5 μC/g. Also, the toner of Example 2 does not have a problem with transfer efficiency and does not cause a white spot.

From the above results, it is clear that the negatively chargeable toner that has high chargeability, has excellent transfer efficiency, prevents a white spot and provides an image with sufficient image density, is produced by incorporating the aluminum coupling agent in the polymerizable monomer composition and using the charge control agent in which the copolymerization ratio of the sulfonic acid group-containing (meth)acrylamide monomer unit is within the specific range of the present invention.

The invention claimed is:

1. A method for producing a negatively chargeable toner, the method comprising:

a suspension step of obtaining a suspension in which droplets of a polymerizable monomer composition comprising at least a polymerizable monomer, a carbon black, a softening agent and a charge control agent are dispersed, by suspending the polymerizable monomer composition in an aqueous dispersion medium comprising a dispersion stabilizer, and a step of obtaining colored resin particles by suspension polymerization using the suspension in the presence of a polymerization initiator, wherein the polymerizable monomer composition is prepared by mixing the polymerizable monomer, the carbon black, the softening agent, an aluminum coupling agent, and the charge control agent that is a sulfonic acid group-containing copolymer which is obtained by copolymerizing a vinyl aromatic hydrocarbon, a (meth) acrylate and a sulfonic acid group-containing (meth) acrylamide and in which a copolymerization ratio of a sulfonic acid group-containing (meth)acrylamide monomer unit in the copolymer is from 0.8 to 4.0% by mass, and wherein a content of the carbon black in the polymerizable monomer composition is from 1 to 10 parts by mass with respect to 100 parts by mass of the polymerizable monomer.

2. The method for producing the negatively chargeable toner according to claim 1, wherein a content of the softening agent in the polymerizable monomer composition is from 1 to 25 parts by mass with respect to 100 parts by mass of the polymerizable monomer.

3. The method for producing the negatively chargeable toner according to claim 1, wherein a weight average molecular weight of the charge control agent is from 5,000 to 30,000.

4. The method for producing the negatively chargeable toner according to claim 1, wherein a content of the charge control agent in the polymerizable monomer composition is from 0.1 to 8.0 parts by mass with respect to 100 parts by mass of the polymerizable monomer.

5. A negatively chargeable toner obtained by the production method defined by claim 1.

6. The method for producing the negatively chargeable toner according to claim 1, wherein a content of the aluminum coupling agent in the polymerizable monomer composition is from 0.5 to 10 parts by mass with respect to 100 parts by mass of the carbon black.

7. The method for producing the negatively chargeable toner according to claim 1, wherein the aluminum coupling agent is an aluminum alcoholate.

8. The method for producing the negatively chargeable toner according to claim 1, wherein the number average primary particle diameter of the carbon black is from 10 to 100 nm.

* * * * *